US006139138A

United States Patent [19]

Powers et al.

[11] Patent Number: 6,139,138

[45] Date of Patent: Oct. 31, 2000

[54] BELLOWS SYSTEM FOR AN INK JET PEN

[75] Inventors: James Harold Powers, Lexington; Matthew Joe Russell, Stamping Ground, both of Ky.

[73] Assignee: Lexmark International, Inc., Lexington, Ky.

[21] Appl. No.: 09/291,028

[22] Filed: Apr. 13, 1999

[51] Int. Cl.[7] ..... B41J 2/19

[52] U.S. Cl. ..... 347/92

[58] Field of Search ..... 349/85, 86, 92, 349/30, 35; 347/93

[56] References Cited

U.S. PATENT DOCUMENTS 4,476,472 10/1984 Aiba et al. .
4,509,062 4/1985 Low et al. .
4,992,802 2/1991 Dion et al. .
5,420,619 5/1995 Glassett et al. ..... 347/30
5,721,577 2/1998 Ostermeier et al. .
5,736,992 4/1998 Pawlowski, Jr. .
5,812,155 9/1998 Seccombe .
5,815,182 9/1998 Otis et al. .
5,821,965 10/1998 Oda et al. ..... 347/86
5,905,518 5/1999 DeFilippis .

*Primary Examiner*—N. Le
*Assistant Examiner*—Michael Nghiem
*Attorney, Agent, or Firm*—Michael T. Sanderson; Luedeka, Neely & Graham

[57] ABSTRACT

The invention relates to a device for removing air or gas bubbles from a ink jet pen. The device includes a gas accumulation chamber attached to an ink cartridge and a gas inlet port in flow communication with the chamber, the inlet port containing a septum for sealing the port. The chamber contains a gas accumulation device and an urging member for urging the gas accumulation device in order to draw gas into the chamber through the inlet port from a cartridge body upon attachment of the cartridge to the body. The gas accumulation device is activated automatically when a new ink cartridge is installed on the cartridge body thereby removing unwanted air and gas bubbles from the ink feed port of the cartridge and cartridge body.

18 Claims, 7 Drawing Sheets

BELLOWS SYSTEM FOR AN INK JET PEN

FIELD OF THE INVENTION

The invention relates to ink jet printers and in particular to apparatus and devices for removing air from an ink feed port of an ink jet printing device.

BACKGROUND OF THE INVENTION

During the life span of an ink jet pen, air or gas bubbles develop in the ink and coalesce into larger bubbles. As the bubbles form and coalesce, they tend to accumulate in the ink feed port, filter areas and ink feed channels of the ink pen. If the amount of air or gas bubbles increases significantly, performance of the pen may be affected. For disposable pens, air accumulation is not typically a significant problem. However, for longer life permanent or semi-permanent pens having a cartridge body and a separate replaceable ink cartridge, and for high quality, high speed printing devices, substantial air or gas bubble accumulation may be a problem.

Some of the air or gas bubbles in the ink flow channels of the pen are removed from the pen through ink ejection orifices of the pen during priming. However, a portion of the air or gas bubbles may find its way back through the ink feed paths into the ink feed port in the connection between the cartridge body and the ink cartridge. Air or gas bubbles may also accumulate in the ink feed port between the cartridge body and ink cartridge by other mechanisms. As ink is introduced into the ink cartridge, an amount of dissolved air is included with the ink. As the ink is heated in the cartridge or printhead, its capacity for dissolved air decreases and the air or gas bubbles are released from the ink. Another source of air or gas bubbles in the ink feed port of a pen arises from the removal and connection of ink cartridges with the cartridge body. If a spent ink cartridge is allowed to run dry of ink, air will fill the ink feed port connecting the cartridge to the cartridge body. Even if the ink cartridge is not run dry of ink, a certain amount of air is introduced into the ink feed port each time an ink cartridge is connected and/or disconnected from the cartridge body.

Priming the pen by ejection of ink may remove air or gas bubbles from the printhead itself, however, there may still be a substantial amount of air in the ink feed port due to ink cartridge replacement. This air is effectively trapped between the cartridge body and the ink cartridge in the connection port connecting the cartridge to the cartridge body.

An object of the invention is to provide an apparatus and method for removing air and gas bubbles from an ink jet pen.

Another object of the invention is to provide a device for removing a substantial quantity of air and a minimum amount of ink from an ink feed port.

Still another object of the invention is to provide a substantially automatic air removal system which is activated upon ink cartridge replacement.

Another object of the invention is to improve the operation of a permanent or semi-permanent ink jet pen.

SUMMARY OF THE INVENTION

With regard to the foregoing and other object and advantages, the invention provides a device for removing air or gas bubbles from an ink jet pen which includes a gas accumulation chamber attached to an ink cartridge and a gas inlet port in flow communication with the chamber, the inlet port containing a septum or other means for sealing the port, wherein the chamber contains a gas accumulation device and an urging member for urging the gas accumulation device in order to draw gas into the chamber through the inlet port from a cartridge body upon attachment of the cartridge to the cartridge body.

In another aspect the invention provides an ink cartridge containing a bellows device for removing air or gas bubbles from an ink feed port for an ink jet pen which bellows device includes a variable volume chamber, an urging device for increasing the volume of the chamber from an initial minimized volume, an air entry port in flow communication with the chamber and a sealing member for effectively sealing the chamber and port in order to maintain the initial minimum chamber volume.

In yet another aspect the invention provides an ink jet pen which includes a cartridge body containing one or more permanent or semi-permanent ink jet printheads, a filtration and air removal system connected to the cartridge body in ink flow communication with the printheads, a replaceable ink cartridge containing an ink supply for supply of ink to the printheads, the ink cartridge being removably connected to the filtration and air removal system and an air or gas bubble removal device attached to the ink cartridge, the air or gas bubble removal device containing a vacuum chamber and a vacuum release port in flow communication with the vacuum chamber, the vacuum release port containing a septum for sealing the port, wherein the vacuum chamber has a bottom portion, a top edge portion and side portions defining a open-ended cavity, a bellows member attached adjacent the top edge portion around a perimeter of the open-ended cavity and an urging device disposed in the cavity between the bellows member and bottom portion thereof.

An advantage of the air or gas bubble removal system of the invention is that the air or gas bubble removal device is configured for substantially automatic activation upon ink cartridge replacement without any other operator intervention. Unlike priming or back-pressure control devices, the device of the invention is adapted for removal of air or gas bubbles so that only gas and/or a minimum amount of ink is removed from the ink cartridge, cartridge body and/or ink supply port. Priming devices typically only remove air from the printhead and ink paths in the printhead itself and are not effective for removing air bubbles from the ink feed port in the connection between the cartridge body and ink cartridge. Likewise, cartridge pressure devices may reduce the formation of air bubbles in the ink cartridge itself by increasing the ink pressure in the cartridge, however, they are not substantially effective for removing air or gas bubbles which are introduced into the ink feed port by running the cartridge dry or when removing and installing a new ink cartridge. The present invention, as described below, provides a substantial improvement in the ability to remove air or gas bubbles from the ink feed port of an ink jet pen.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein.

DETAILED DESCRIPTION OF THE INVENTION

Figure 1:
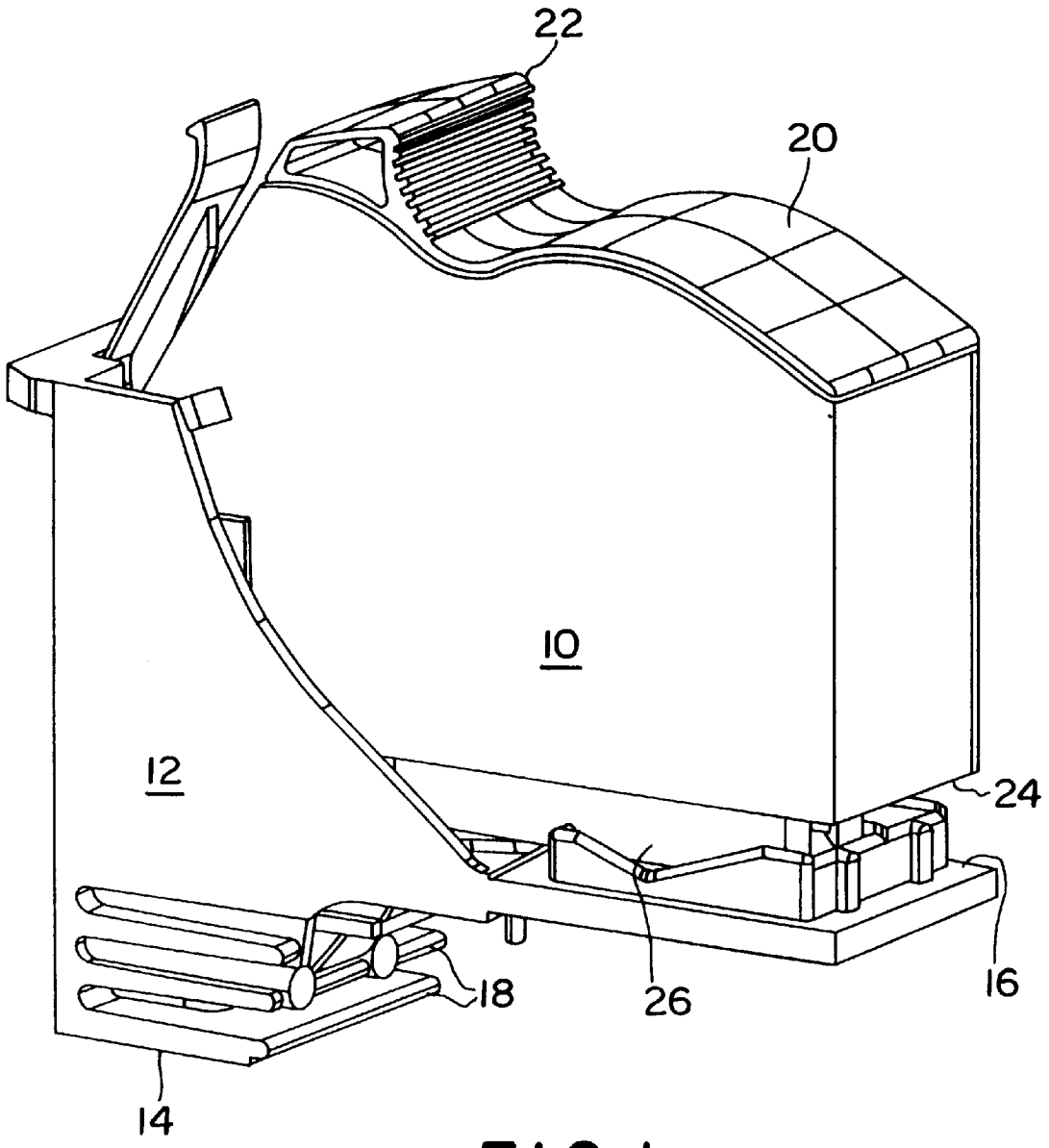
FIG. 1 is a perspective view of a removable ink supply cartridge assembled to a cartridge body for use in an ink jet printer.

With reference to FIG. 1, there is shown, in perspective view, a replaceable ink cartridge 10 connected to a permanent or semi-permanent cartridge body 12. The ink cartridge 10 may contain a single color ink, such as black, cyan, magenta or yellow or may contain multiple colors of ink. The cartridge body 12 may be configured to attach to a single cartridge 10 or may be expanded to hold multiple cartridges 10. In the case of a single color ink cartridge 10, the cartridge body 12 typically contains a single printhead 14 on a side of the cartridge body 12 opposite the ink cartridge connection side 16 thereof. In the case of multiple cartridges 10 or multicolor cartridges 10, the cartridge body 12 may contain multiple printheads 14, typically three or four printheads 14.

In high speed, high quality printing operations, it is preferred that the cartridge body 12 be adapted to remove heat from the printhead. This may be accomplished by constructing the cartridge body 12 out of a heat conducting metal such as aluminum or zinc and/or by providing heat conducting fins 18 on the body 12 to conduct heat away from the printhead by conduction and convection.

Figure 2A:
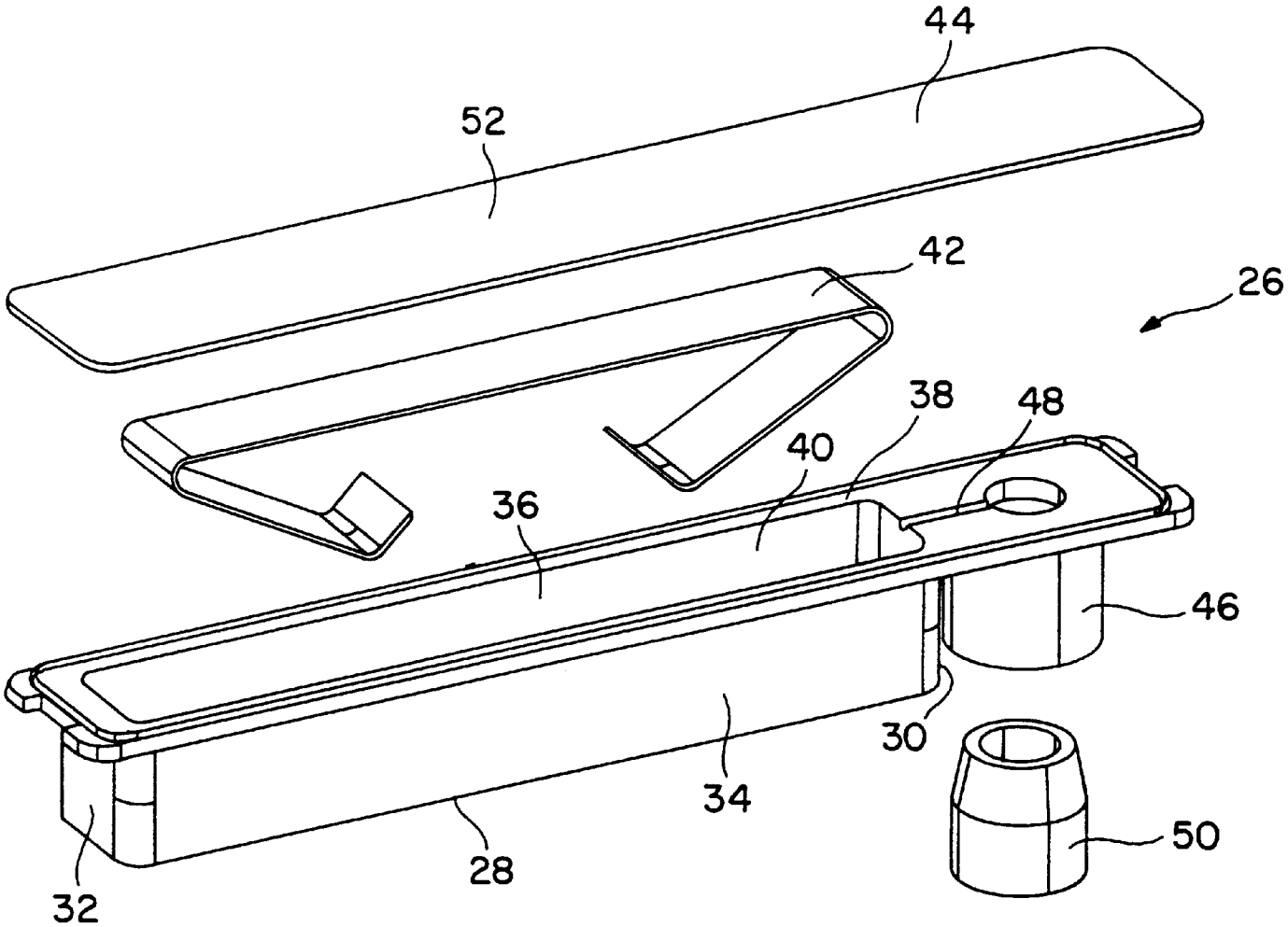
FIG. 2A is an exploded view in perspective of an air or bubble removal device according to the invention.

With regard to the ink cartridge 10, the cartridge 10 has an upper portion 20 containing a handle 22 and a lower portion 24. A gas accumulation chamber 26 is preferably attached to the lower portion 24 of the cartridge 10. An exploded view of a preferred gas accumulation chamber 26 is shown in FIG. 2A.

The gas accumulation chamber 26 includes a bottom portion 28, end portions 30 and 32, side portions 34 and 36 and a top edge or perimeter portion 38 defining an open-ended cavity 40. An urging device 42 is disposed in the cavity 40 and a substantially impermeable flexible member 44 is attached along the top perimeter portion 38 to define a closed gas accumulation chamber 26.

The urging member 42 is preferably a resilient leaf spring device which is disposed in the cavity 40, preferably in an initially compressed state, between the bottom portion 28 and the flexible member 44. The purpose of the urging member 42 is to urge the flexible member 44 in a direction away from the bottom portion 28 of the cavity 40 upon connection of the accumulation chamber 26 to an ink jet cartridge body as will be described in more detail below. A wide variety of urging members 42 may be used, including but not limited to coil springs and resilient elastomeric open cell foam materials. Useful elastomeric foam materials include, but are not limited to, unfelted ether or ester type polyurethane foams and open-cell polyolefinic foams. Such foam materials are described, for example, in U.S. Pat. No. 5,400,067 to Day incorporated herein by reference as if fully set forth.

The flexible member 44 is preferably made of a resilient thin film material such as a low density polyethylene film, polypropylene film, cellophane, vinyl and the like which is attached to the top edge or perimeter portion 38 of the cavity 40. An air-tight seal is preferably formed between the flexible member 44 and the top edge portion of the cavity 40 by melting the edges of the flexible member 44 around the perimeter of the cavity 40 and/or by use of adhesives. Other means such as clamp rings, etc. may be used to sealingly attach the flexible member thereby enclosing the open-ended cavity 40 of the gas accumulation chamber 26. It is preferred that the flexible member 44 be resilient so that it can be initially urged toward the bottom portion 28 of the cavity thereby depressing the urging member 42 without tearing or excessive stretching thereof. By urging the flexible member toward the bottom portion the volume of the cavity 40 is initially minimized.

The gas accumulation chamber 26 also contains a gas inlet port 46 which is in flow communication with the cavity 40 by means of a gas flow channel 48. The gas flow channel 48 preferably has a width of from about 0.3 to about 3 millimeters and a height of from about 0.3 to about 3 millimeters in order to minimize the pressure difference required to move gas bubbles through the channel 48. In order to provide an accumulation chamber 26 having an initial subatmospheric pressure in the cavity 40 thereof, air is urged from the cavity 40 by depressing the flexible member 44 and urging member 42 toward the bottom portion 28 of the cavity 40 and sealing the gas inlet port 46 with a port sealing device 50. A preferred port sealing device 50 is an elastomeric septum which may be punctured by a needle-like device and which effectively seals around the circumference of the needle-like device after puncture thereof to substantially eliminate any air or gas leakage therebetween.

Air or gas may thus be introduced into the gas accumulation chamber 26 by means of puncturing the port sealing device 50 thereby causing urging device 42 to urge the flexible member 44 upward and away from the bottom portion 28 of the cavity 40 as the air or gas flows from gas inlet port 46, through channel 48 into cavity 40. Urging device 42 therefor causes a suctioning effect as the flexible member 44 is urged upward and away from the bottom portion 28 and the volume of the cavity 40 is effectively increased.

As shown, the cavity 40 within the vacuum chamber 26 is preferably an elongate substantially rectangular cavity 40. The cavity 40 preferably has an expanded volume ranging from about 0.4 to about 6.0 milliliters. The invention is not intended to be limited to the shape of the gas accumulation chamber 26 or cavity 40 or other components as shown in FIG. 2 as other shapes may be used for the components. For example, the gas accumulation chamber 26 may be a cylindrical, spherical, oval and the like, provided the cavity 40 has sufficient volume for removal of air or gas bubbles from the ink feed port areas of the cartridge and cartridge body.

After initially depressing the flexible member 44 towards the bottom portion 28, and sealing the gas inlet port 46 with a septum 50, the entire gas accumulation chamber 26 is attached to an ink cartridge 10 so that side 52 of the flexible member 44 opposite the cavity is adjacent the lower portion 24 of the cartridge 10 (FIG. 1). The gas accumulation chamber 26 may be removably connected to the lower portion 24 as by means of clips or may be permanently attached to the cartridge 10 as by thermoplastic welding techniques or by use of adhesives.

Alternative gas accumulation devices are illustrated in schematic cross-sections in FIGS. 2B–2E. In these figures, the gas accumulation devices 26 are substantially rectangular devices which include a bellows chamber 62 containing a bellows 64 and an urging member such as spring 66 or spring 68. The bellows 64 is in flow communication via a gas flow channel 70 with an inlet port 72 containing a septum 50 as described above or other means for sealing the port. The bellows 64 preferably contains a release mechanism comprising a rigid plate 76 attached to spring 66 or 68 and a trigger device such as pin 78 attached to plate 76.

Figure 2B:
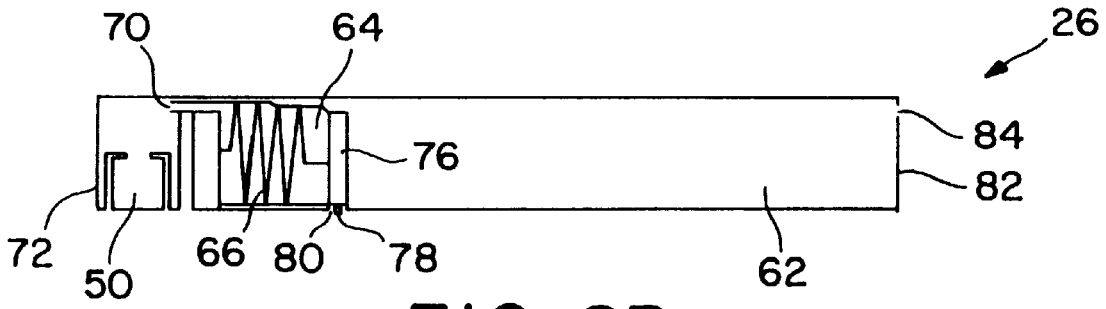
FIGS. 2B, 2C, 2D and 2E are schematic cross-sectional views of alternative air or bubble removal devices according to the invention.
Figure 2C:
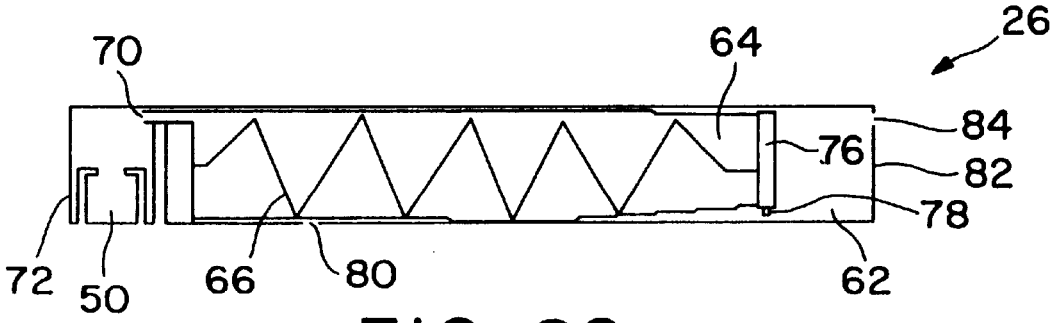
Figure 2D:
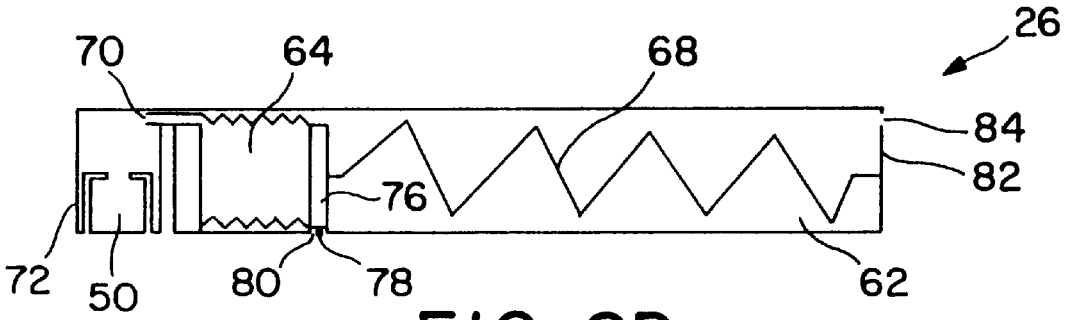
Figure 2E:
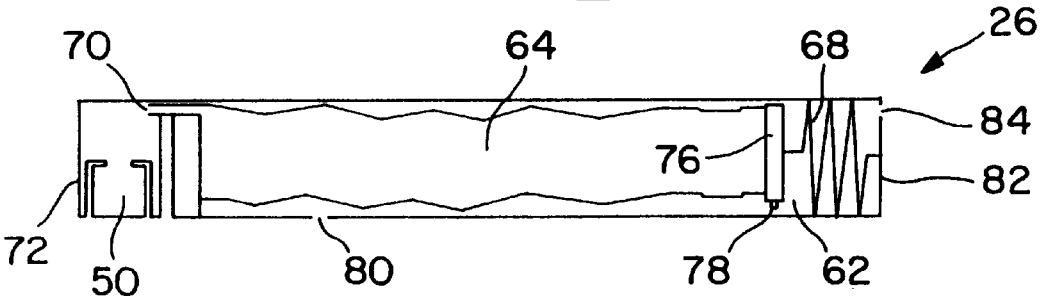

In its initial state, pin 78 is engaged with trigger hole 80. Upon attachment of the ink cartridge to the cartridge body, a trigger release device is inserted into hole 80 thereby urging pin 78 therefrom. In FIG. 2B, spring 66 is under compression so that upon activation of the release mechanism, spring 66 urges plate 76 toward the opposing end 82 of the chamber 62 as shown in FIG. 2C. In FIG. 2D, spring 68 is under tension, so that upon activation of the release mechanism, plate 76 is urged toward end 82 by spring 68 as shown in FIG. 2E. An air hole 84 is preferably contained in end 82 to allow air to escape from the chamber 62 upon activation of the release mechanism. A variety of release mechanisms may be used to maintain the bellows in a compressed state until activation of the gas accumulation device when a cartridge is attached to a cartridge body. Such release mechanisms may include latch pins, levers, cams and the like for maintaining spring 66 under compression or spring 68 under tension. It will be recognized that the bellows 64 in chamber 62 may be replaced by a bulbous chamber such as an aspirator or a bellows device having resiliency and an inherent memory sufficient to cause expansion of the bellows or aspirator from a compressed state to an expanded state without the need for spring 66 or 68.

Figure 3:
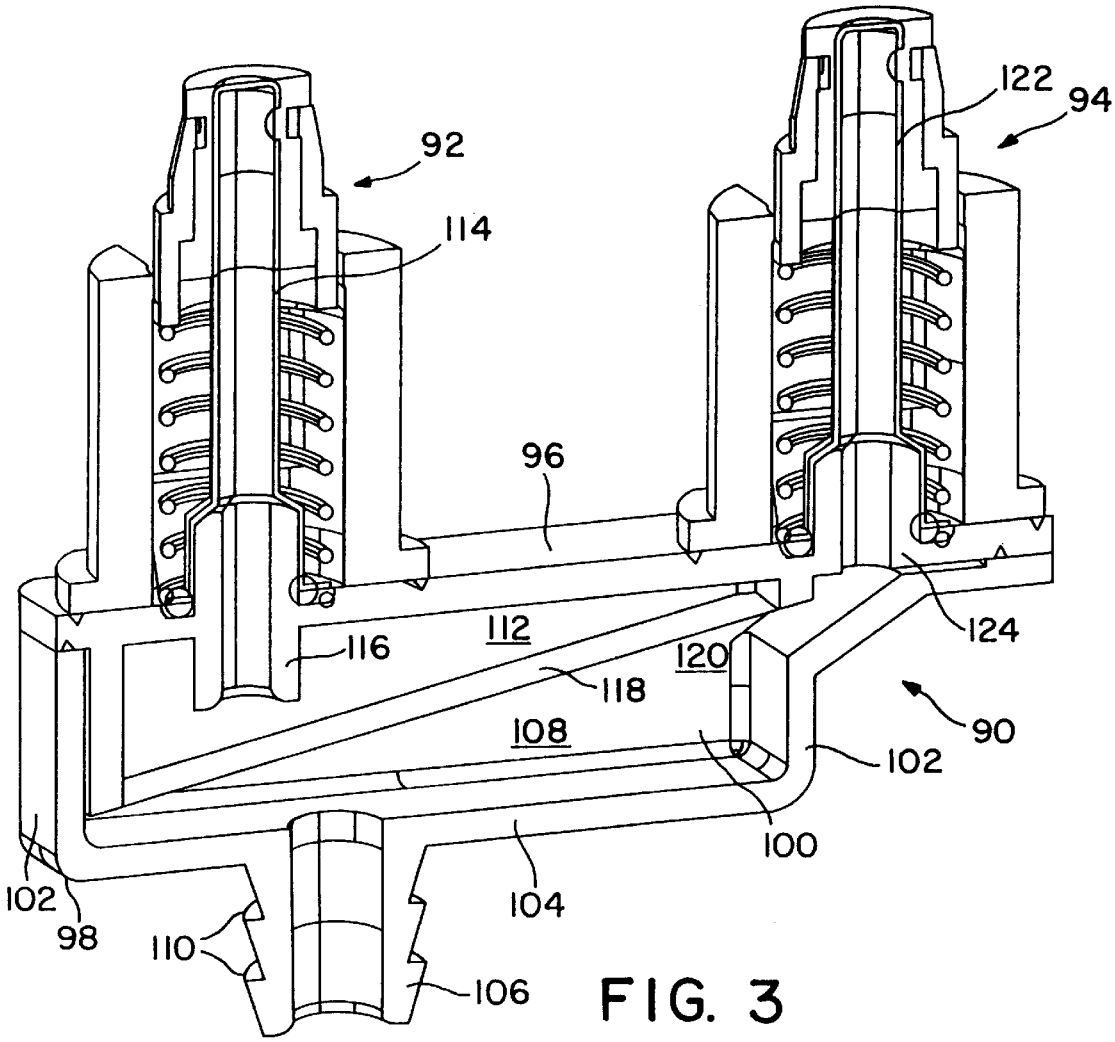
FIG. 3 is a perspective cross-sectional view of a filter tower and air removal structure for use in conjunction with the air or bubble removal device of the invention.

Another important feature of the invention is an ink filtration and air removal system 90 shown in cross-sectional view in FIG. 3. The air removal system 90 cooperates with the gas accumulation chamber 26 such that when the ink cartridge is installed on the system 90, the sealing device 50 is punctured causing a suctioning effect for removal of air or gas bubbles from the cartridge body upon expansion of the volume of the cavity 40 (FIG. 2A) or expansion of bellows 64 (FIGS. 2B–2E).

The ink filtration and air removal system 90 includes an ink feed needle valve assembly 92 and a gas removal needle valve assembly 94 attached to an upper portion 96 of an elongate, subtantially rectangular filter cavity 98. The filter cavity 98 is defined by the upper portion 96, side walls 100, end walls 102 and bottom portion 104. An ink outlet port 106 is attached to the bottom portion 104 and is in flow communication with a filtered ink and gas chamber 108 of the filter cavity 98. The outlet port 106 preferably contains barbs or palls 110 or grooves which are used to sealingly connect the filtration and air removal system 90 to the cartridge body.

Ink and air or gas flows into an upper portion 112 of the filter cavity 98 through an elongate ink needle 114 and ink inlet port 116 attached to the top portion 96. Debris and impurities are removed from the ink in the upper portion 112 by means of filter element 118 so that purified ink accumulates in the filtered ink and gas chamber 108. Because the filter element 118 is angled and not horizontally disposed in the filter cavity 98, air or gas bubbles are caused to accumulate in a gas accumulation area 120 of the cavity 98 adjacent a gas removal needle valve assembly 94. The gas removal needle valve assembly 94 contains an elongate gas removal needle 122 which is in flow communication with the gas accumulation area 120 by means of a gas removal port 124 which is formed in the upper portion 96 of the filter cavity 98.

Figure 4:
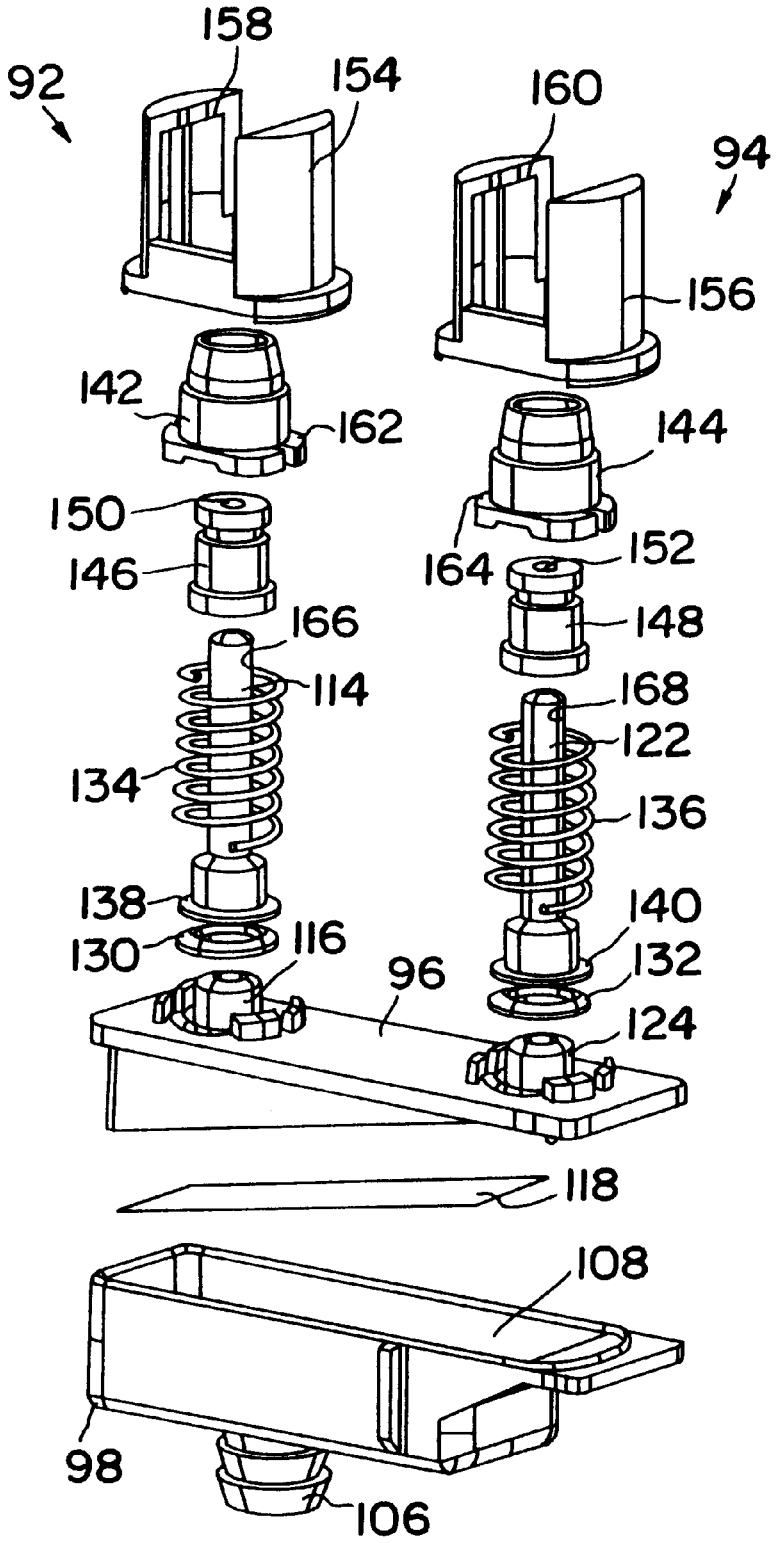
FIG. 4 is an exploded view in perspective of a filter tower and air removal structure for use in conjunction with an air or bubble removal device of the invention.

Details of the filtration and air removal system 90 shown in FIG. 3 may be seen in an exploded view of the system 90 with further reference to FIG. 4. As can be seen, needle valve assemblies 92 and 94 are preferably substantially the same. The assemblies 92 and 94 include elongate needles 114 and 122, respectively, which are sealingly attached to ports 116 and 124, respectively, by means of resilient sealing devices such as o-rings 130 and 132. Valve springs 134 and 136 are disposed around elongate needles 114 and 122 between needle flanges 138 and 140 and spring urging devices 142 and 144. The spring urging devices 142 and 144 carry cylindrical valves 146 and 148, respectively, having annular openings 150 and 152 therein for receiving the elongate needles 114 and 122 therethrough. Valve guides 154 and 156 are attached to the top portion 96 and contain valve travel stop ledges 158 and 160 which engage flanges 162 and 164 of the spring urging devices 142 and 144.

In their closed positions, valves 146 and 148 are urged away from top portion 96 by springs 134 and 136 so that the valves 146 and 148 cover inlet holes 166 and 168 in elongate needles 114 and 122. Upon attachment of an ink cartridge 10, spring urging devices 142 and 144 are urged toward upper portion 96 thereby depressing springs 134 and 136 and lowering valves 146 and 148 to expose ink inlet hole 166 and gas outlet hole 168. Upon removal of the ink cartridge 10, the springs 134 and 136 again urge valves 146 and 148 away from the top portion 96 so that valves again cover and seal ink inlet hole 166 and gas outlet hole 168.

Figure 5:
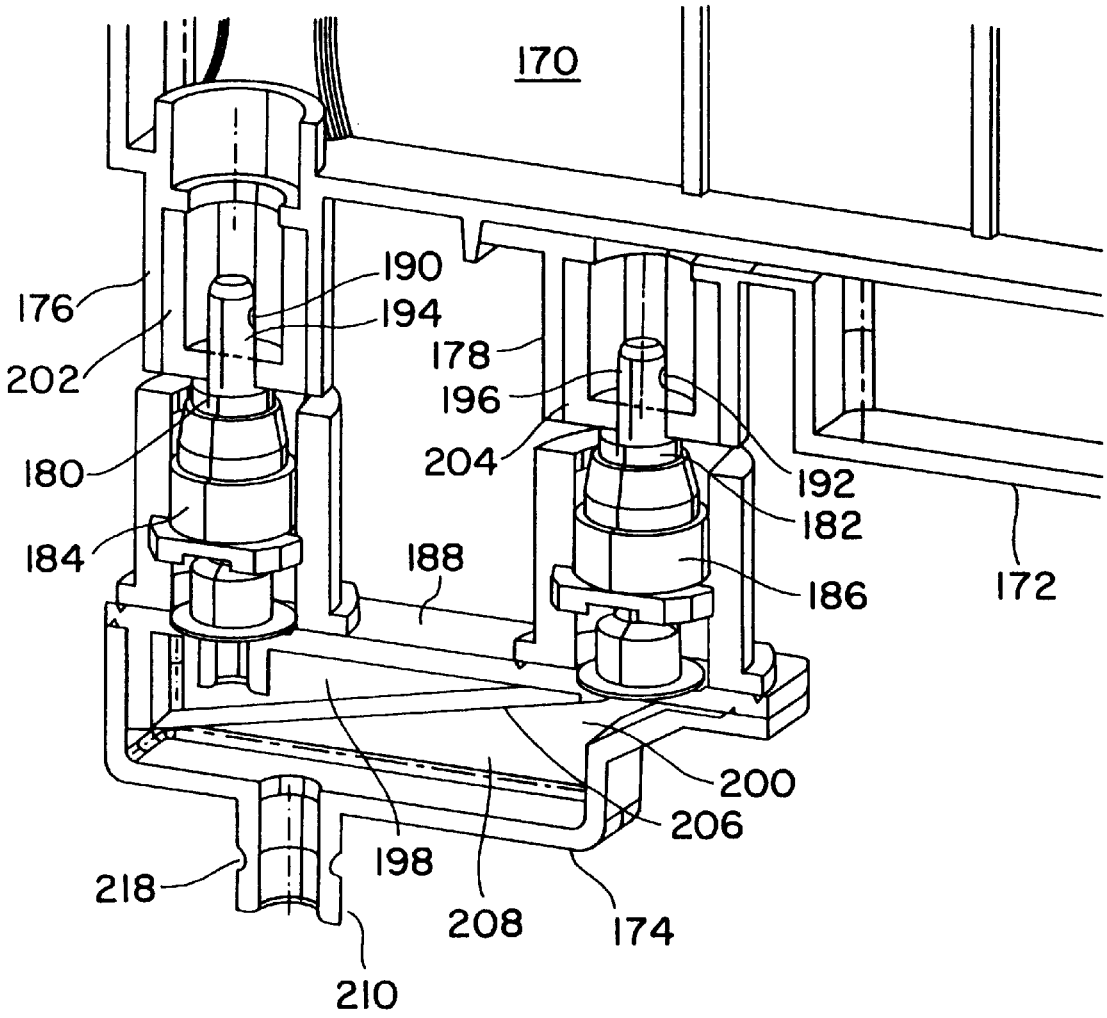
FIG. 5 is a cross-sectional view of a filter tower and air removal structure assembled to a removable ink supply cartridge containing an air or bubble removal device of the invention.

With reference now to FIG. 5, a partial cross-section view of an ink cartridge 170 (similar to cartridge 10), gas accumulation chamber 172 (similar to gas accumulation chamber 26) and filtration and air removal system 174 (similar to system 90) is shown with the filtration and air removal system 174 being engagedly connected to the ink cartridge 170. When the ink cartridge 170 and filtration and air removal system 174 are connected, ink supply port 176 and air or gas bubble removal port 178 engage valves 180 and 182, respectively, which in turn urge spring urging devices 184 and 186 toward upper portion 188 of the filtration and air removal device 174. Upon urging valves 180 and 182 downward, ink inlet hole 190 and gas outlet hole 192 of needles 194 and 196, respectively, are uncovered so that the filter cavity 198 is connected in flow communication with the ink outlet port 176 of the ink cartridge by means of ink needle 194. Likewise, the gas accumulation area 200 is connected in flow communication with the air or gas bubble removal port 178 for flow of air and/or gas through gas outlet needle 196 into the gas accumulation chamber 172.

In order to seal the ink supply port 176 of the ink cartridge 170 against flow of ink out of the cartridge adjacent ink needle 194, ink supply port 176 preferably contains an elastomeric septum 202 which sealingly engages needle 194. Likewise, air or gas bubble removal port 178 preferably contains a septum 204 for sealingly engaging needle 196. Upon flow of ink into filter cavity 198, the ink is filtered to remove particles and debris by filter 206 and the purified ink flows into the filtered ink portion 208 for flow out of ink supply port 210 into the cartridge body.

Figure 6:
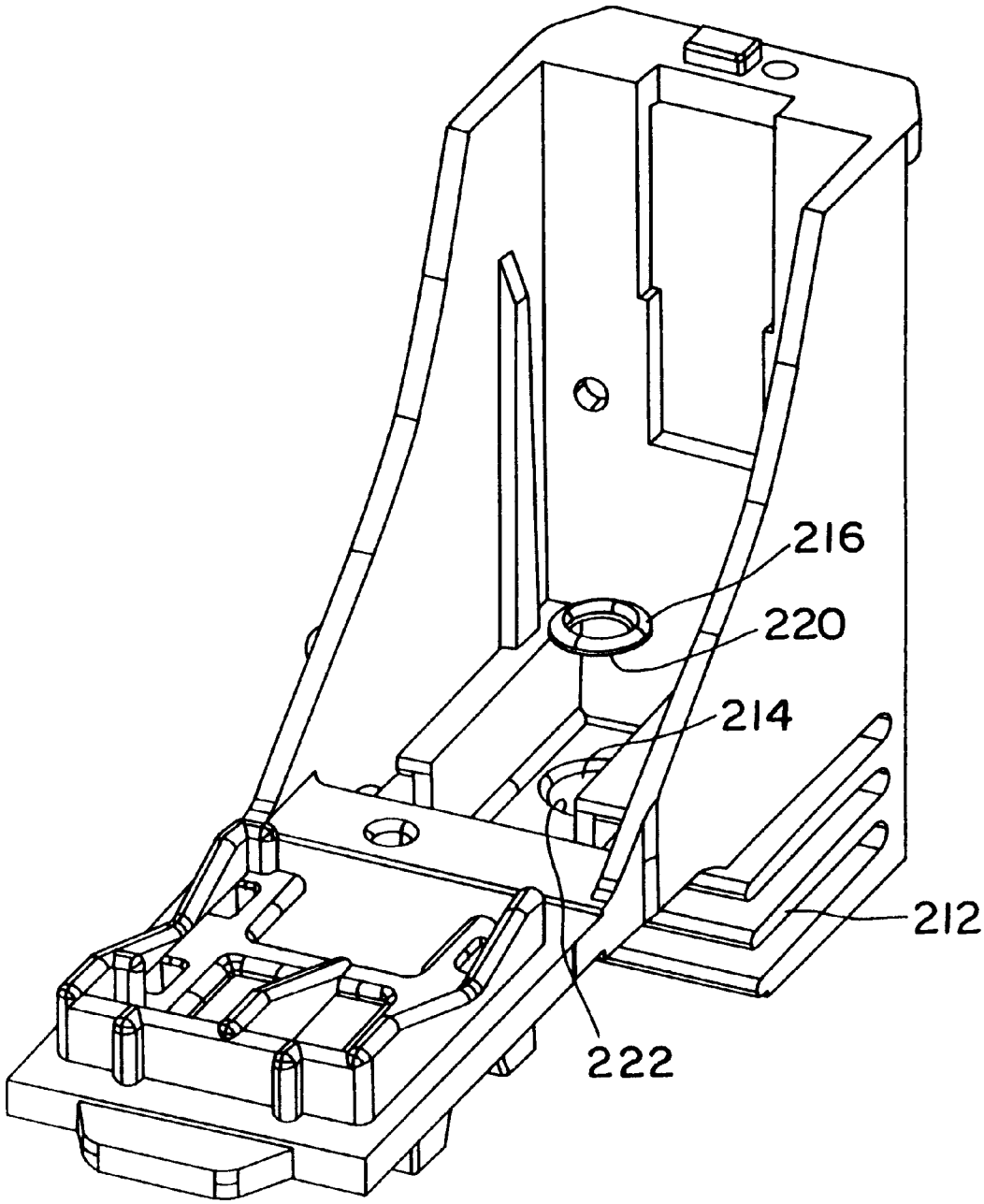
FIG. 6 is a perspective view of a cartridge body for use with a disposable ink supply cartridge.

Connection of the filtration and air removal device 174 to a cartridge body 212 (FIG. 6) may be effected by inserting the ink supply port 210 into a hole or aperture 214 in the body 212. In order to sealingly connect the ink supply port 210 with aperture 214, an elastomeric bushing, collar or o-ring 216 may be inserted into the aperture 214 or disposed around the ink supply port 210 so that o-ring engages groove 218 on the supply port 210 and forcing the outside surface area 220 of o-ring 216 in close adjacency with the inside surface area 218 of aperture 214. The o-ring 216 is preferably made of an elastomeric material, including, but not limited to, natural rubber, synthetic rubber, polyurethane foam, ethylene-propylene-diene monomer (EPDM), silicone and the like, provided the material selected for the o-ring is resistant to the ink and effectively forms a seal to prevent ink or air leakage therethrough. Other means may be used to seal the connection between the ink supply port 210 and the aperture 214 in cartridge body 212 including, but not limited to, the use of adhesive with or without the use of o-ring 216, use of an elastomeric bushing or an elastomeric collar and thermoplastic welding of the filtration and air removal device 174 to the cartridge body 212 and the like.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. An ink jet pen comprising a cartridge body containing one or more permanent or semi-permanent printheads, a filtration and air removal system connected to the cartridge body in ink flow communication with the printheads, a replaceable ink cartridge containing an ink supply for supply of ink to the printheads, said ink cartridge being removably connected to said filtration and air removal system and an air or gas bubble removal apparatus attached to said ink cartridge, the air or gas bubble removal apparatus containing an expandable chamber and a gas inlet port in flow communication with the expandable chamber, wherein the expandable chamber has an urging device disposed in the chamber for expanding the expandable chamber.

2. The ink jet pen of claim 1 wherein the urging device comprises a leaf spring.

3. The ink jet pen of claim 1 wherein the urging device comprises a resilient elastomeric foam material.

4. The ink jet pen of claim 1 wherein the urging device is initially compressed so that upon introduction of air or gas into the expandable chamber, the urging device urges expansion of the expandable chamber.

5. The ink jet pen of claim 1 wherein the filtration and air removal system further comprises a filter chamber containing a filter element, an ink inlet port for ink flow connection to said ink cartridge, an air outlet port for flow connection to said air or gas bubble removal device and an ink outlet port for flow of filtered ink to said cartridge body containing printheads.

6. The ink jet pen of claim 5 wherein the filtration and air removal system further comprises an ink inlet needle valve attached to said ink inlet port.

7. The ink jet pen of claim 6 wherein the filtration and air removal system further comprises an air outlet needle valve attached to said air outlet port.

8. The ink jet pen of claim 5 wherein the ink outlet port is connected to said cartridge body by means of a resilient elastomeric o-ring.

9. The ink jet pen of claim 5 wherein said filter chamber comprises a substantially rectangular cavity and said filter element is disposed at an angle in said rectangular cavity whereby an air or gas bubble accumulation area is formed adjacent said air outlet port.

10. An apparatus for removing air or gas bubbles from an ink jet pen which comprises a gas accumulation chamber attached to a replaceable ink cartridge, the gas accumulation chamber containing a flexible member, an urging device for urging the flexible member and a gas inlet port in flow communication with said gas accumulation chamber for connection to a cartridge body of the ink jet pen, whereby said urging device urges the flexible member upon attachment of the cartridge to the cartridge body in order to draw gas into the chamber from a cartridge body through the inlet port.

11. The apparatus of claim 10 wherein the urging device comprises a leaf spring.

12. The apparatus of claim 10 wherein the urging device comprises a resilient elastomeric foam material.

13. The apparatus of claim 10 wherein the flexible member comprises a polymeric film attached to a periphery edge of the chamber defining a cavity volume and wherein the urging device is initially compressed so that the cavity volume is initially minimized.

14. A replaceable ink cartridge for attaching to an ink jet pen, the cartridge containing a variable volume apparatus for removing air or gas bubbles from an ink feed port of the ink jet pen which variable volume apparatus is attached to the ink cartridge and comprises chamber containing a bellows having a first end and second end, the first end of the bellows being attached to a first end wall of the chamber, the second end of the bellows being attached to a rigid plate, an urging device disposed under tension or compression for expanding the volume of the bellows from an initial minimized volume, an air entry port in flow communication with an interior of said bellows, a sealing member for effectively sealing said port in order to maintain the initial minimum bellows volume and a release mechanism for releasing tension or compression of the urging device upon attachment of the ink cartridge to an ink jet pen body.

15. The replaceable ink cartridge of claim 14 wherein the urging devices comprises a spring disposed inside the bellows, one end of the spring being attached to the rigid plate, the spring being initially compressed so that the bellows has a volume which is initially minimized.

16. The replaceable ink cartridge of claim 14 wherein the urging devices comprises a spring disposed external to the bellows, one end of the spring being attached to the rigid plate opposite the bellows, the spring being initially tensioned so that the bellows has a volume which is initially minimized.

17. The ink cartridge of claim 14 wherein the variable volume apparatus is attached to an exterior sidewall of the ink cartridge.

18. The ink cartridge of claim 14 wherein said sealing member comprises a septum.

* * * * *